United States Patent [19]

Kopp

[11] Patent Number: 4,537,397

[45] Date of Patent: Aug. 27, 1985

[54] FOOTBALL KICKING TEE

[76] Inventor: Harold W. Kopp, 137 Daytona Ave., R.R. 6A, Narragansett, R.I. 02882

[21] Appl. No.: 445,825

[22] Filed: Dec. 1, 1982

[51] Int. Cl.[3] ..... A63B 67/00

[52] U.S. Cl. ..... 273/55 B

[58] Field of Search ..... 273/33, 202, 203, 204, 273/205, 206, 207, 208, 209, 210, 211, 212, 55 R, 55 B; 119/61, 51 R; D21/29

[56] References Cited

U.S. PATENT DOCUMENTS

| | | | |
|---|---|---|---|
| 1,410,483 | 3/1922 | Lard | 273/203 |
| 1,616,059 | 2/1927 | Muivehill | 273/202 |
| 3,309,087 | 3/1967 | Cullity | 273/55 B |
| 3,467,390 | 9/1969 | Gardiner | 273/202 |
| 3,611,998 | 12/1971 | Loscalzo | 119/51 R |
| 4,418,910 | 12/1983 | Stenerud | 273/55 B |

FOREIGN PATENT DOCUMENTS

| | | | |
|---|---|---|---|
| 11967 | of 1910 | United Kingdom | 273/210 |

*Primary Examiner*—Richard C. Pinkham
*Assistant Examiner*—T. Brown
*Attorney, Agent, or Firm*—Charles S. McGuire

[57] ABSTRACT

The combination of a regulation football and kicking tee wherein the tee is formed as a single, contiguous wall of closed, circular cross section extending from a lower, ground engaging portion to an upper edge upon which the ball is supported. The ball supporting edge is preferably in a substantially horizontal plane when the tee is in use, extending about the upper perimeter of the wall for between 220° and 300° with the remaining area, i.e., 60° to 140°, representing a discontinuity in the wall extending downwardly from the ball supporting edge. Thus, the lower end of the ball may pass through the discontinuity without substantial interference by the tee when kicked therefrom. The wall member is entirely formed of a material which is very resilient to avoid the possibility of injury to the kicker's foot.

5 Claims, 4 Drawing Figures

FOOTBALL KICKING TEE

BACKGROUND OF THE INVENTION

The present invention relates to kicking tees of the type used to support a standard, ellipsoidal football for kick-off.

In the sport of football, as is well known, the ball is normally supported upon a tee for kicking to the opposing team at such times as kick-offs are provided by the rules. A number of types of kicking tees have been utilized through the years, one of the most popular present models being that described in U.S. Pat. No. 3,309,087. This tee includes a pair of upwardly extending supports against which the rear side of the ball, i.e., the side contacted by the kicker's foot, rests for supporting the ball in a desired orientation. The supports are of equal height and positioned in spaced relation along a line perpendicular to the normal direction of straight-away kicking of the ball from the tee.

While tees of the aforementioned design are generally satisfactory for kickers using a straight-way kicking style, where the toe meets the ball and may pass between the upright supports on the tee, injuries have resulted to so-called soccer style kickers who make ball contact with the instep. This is due to the high impact in a concentrated area just above the big toe upon contact with the rigid material of the upstanding ball support on the side of the tee from the kicker approaches. Since the proportion of place kickers employing the soccer style is ever-increasing, particularly at the higher skill levels of the sport, the aforementioned style of kicking tee is subject to serious limitations.

A kicking tee specifically designed for use by soccer style kickers shows in U.S. Pat. No. 4,418,910, has more recently come into general use. It includes a pair of rear ball supports which extend upwardly a shorter distance than those of the aforementioned tee and are offset from front to rear in order to compensate for the approach of the kicker at an angle to the direction of the kick and instep contact with the ball. One problem with this tee, however, is that the ball may be blown off rather easily, often requiring that another player hold the ball manually in high winds.

It is a principal object of the present invention to provide a kicking tee which provides stable support for an ellipsoidal football while essentially eliminating any possibility of injury to the kicker's foot.

Another object is to provide a football kicking tee possessing the aforementioned advantages which is simple in design and economical in fabrication.

Other objects will in part be obvious and will in part appear hereinafter.

SUMMARY OF THE INVENTION

In accordance with the foregoing objects the invention comprises a kicking tee formed as a single, contiguous wall member of resilient material which may be easily flexed but returns to its original configuration, namely, an open cylinder or, preferably, a truncated cone. The wall has a lower, ground engaging portion, preferably a continuous, circular edge, an upper, ball supporting portion, preferably a partial, circular edge extending some 240°, more or less, about the upper periphery of the wall. The wall extends downwardly on the forward side of the tee from the upper edge for a part of the distance to the lower edge, forming a cutout section to provide a clearance opening for the lower end of the ball, substantially avoiding interference from the tee when the ball is kicked.

Vertical and horizontal markings are preferably provided on the forward side of the tee below the cut-out portion to assist in accurate positioning of the tee and ball. Dimensions are chosen so that the ball is not higher than the maximum limit allowed by the rules when supported on the tee.

DETAILED DESCRIPTION

Figure 1:
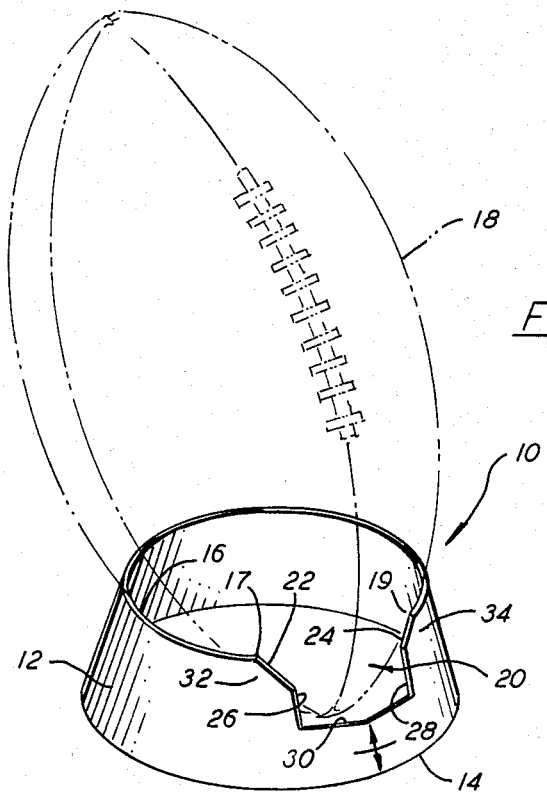
FIG. 1 is a perspective view of the kicking tee of the invention showing in phantom lines a football supported thereon.
Figure 2:
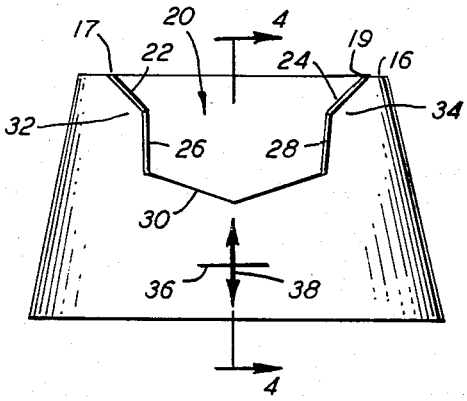
FIG. 2 is a front elevational view.
Figure 3:
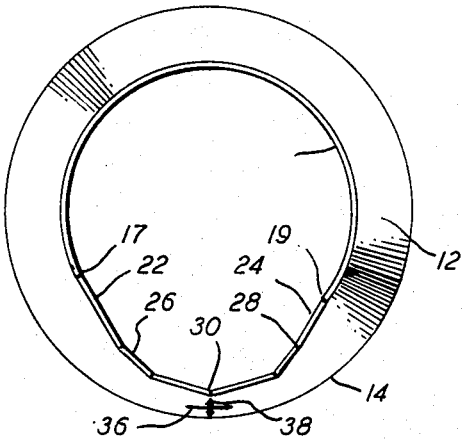
FIG. 3 is a top plan view.
Figure 4:
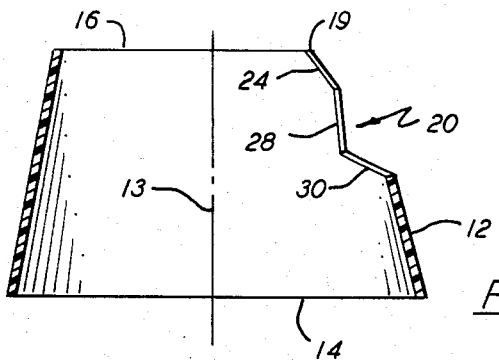
FIG. 4 is a side elevational view on the line 4—4 of FIG. 2.

Referring now to the drawing, the kicking tee is denoted generally by reference numeral 10 comprising a unitary body member formed by wall 12 having central axis 13 (FIG. 4), the wall being of closed cross section in a plane transverse to axis 13. Wall 12 includes at one end a continuous, circular edge 14 lying in a flat plane, and is considered the lower edge, being the portion of the tee which engages the ground when the tee is in use. Upper edge 16, upon which the football 18 rests when positioned on tee 10, is also of circular configuration but does not extend continuously around the upper end of the tee, thus forming a segment of a circle extending between ends 17 and 19.

The upper, front portion of wall 12 extends downwardly from edge 16 to form a so-called cut-out portion, denoted generally by reference numeral 20. The edges defining cut-out portion 20 extend downwardly from upper edge 16 on each side at obtuse angles for first edge portions 22 and 24, then at steeper angles or essentially vertically for second edge portions 26 and 28 which are joined at their lower ends by edge portion 30 which may be horizontal, downwardly curved, V-shaped (as shown), or of other desired configuration. Likewise, first and second edges portions 22, 26 and 24, 28 may be straight or curved in continuous lines, but preferably are so shaped that tabs or resilient flap portions 32 and 34 are provided on each side of cut-out portion 20.

The material of wall 12 is rubber or a plastic of proper resiliency to permit the wall to be flexed inwardly quite easily, while returning to its original shape when the flexing force is removed. Tee 10 is sufficiently rigid along its vertical axis, however, that football 18 is easily supported therby; in fact, due to the closed configuration and upwardly inward taper of wall 12 a great deal more force than the weight of a football may be applied to upper edge 16 before buckling of the wall occurs. Unless football 18 is positioned with its longitudinal axis vertical, which is rarely the case for normal kicks, the portion thereof contacting edge 16 will not be circular, but slightly elliptical, becoming more so as the angle of the ball axis approaches the horizontal. Although edge 16 could be formed to be elliptical in plan view, even though it is of the partial circular configuration shown, in a flat plane parallel to that of lower edge 14, the resiliency of the material of wall 12 will allow edge 16 to conform to the portion of football 18 in contact therewith in virtually any desired orientation of the ball axis with respect to tee 10. Tabs 32 and 34 may be flexed outwardly to some extent in conforming to the ball configuration, providing greater stability of the ball position on the tee.

Current official rules allow the football to be teed up a maximum of two inches above the ground. Thus, the dimensions of edge 16 and its height above the ground, i.e., above lower edge 14, are selected to hold the lowest point on the ball not more than two inches off the ground in all normal orientations of the ball upon the tee. This is provided, for example, by an upper edge about 3 inches high (above ground level) and a diameter of about 4 inches. The perimetral extent of edge 16, between points 17 and 19 is about 240° in the illustrated embodiment, preferably being not less than 220° nor greater than 300°. The height of edge 30, at least at the mid-point, is not more than $1\frac{1}{2}$ inches. Although the configuration of wall 12 may be cylindrical, it preferably is that of a truncated cone, tapering inwardly from edge 14 to edge 16 for greater stability of the tee. For example, in a tee having a diameter of 4 inches and a height of 3 inches at upper edge 16, the diameter of lower edge 14 may be about 5 inches. Indicia in the form of horizontal and vertical lines 36 and 38, respectively, are provided on the outer surface of wall 12 between edges 12 and 30 to assist in proper alignment of the tee upon the ground and the ball upon the tee. Although it is preferred that wall 12 be open at both ends, the lower end could be fully or partly closed by a wall in the plane of edge 14. Also, while lower edge 14 is preferably a continuous, circular edge, it could be of other configurations as long as the ground engaging portions are in a single, flat plane. Wall 12 is shown as being of constant thickness, and has been found to function well in such configuration, but could have a varying thickness, for example, being somewhat thicker at the bottom for greater stability.

What is claimed is:

1. In the placement kicking function of the sport of football, the combination comprising:

(a) a regulation size and weight football of substantially ellipsoidal shape having bluntly pointed ends;

(b) a tee supporting said ball above ground level to be met by the foot of a kicker;

(c) said tee consisting essentially of a continuous wall member configured as a truncated cone having a central axis and tapering inwardly from a lower, ground engaging end lying in a flat plane to an open, upper, ball supporting end;

(d) said ball supporting end comprising an upper edge of said wall extending in a segment of a circle for a perimetral distance of between about 220° and 300°;

(e) said ball resting upon said edge and supported by said wall with one of said pointed ends extending not greater than a predetermined maximum distance into said cone, whereby said end is at least a predetermined minimum distance from said flat plane;

(f) said wall member including a cut-out section extending from the ends of said edge of said ball supporting end toward said ground engaging end for a distance at least as great as said maximum distance, whereby said ball may be kicked from said tee with said one end of said ball passing through said cutout section without substantial interference; and (g) said wall member being formed entirely of a material which is easily deformable in directions transverse to said central axis, thereby presenting virtually no resistance to the foot of a kicker impacting upon said tee, and sufficiently rigid in the direction of said central axis by virtue of said truncated cone configuration to support said regulation weight ball upon said ball supporting end.

2. The invention according to claim 1 and further comprising indicia markings on said wall in the form of lines parallel and perpendicular to the central axis thereof, said markings appearing below said cut-out section, whereby said markings are entirely visible when said ball is supported on said tee.

3. The invention according to claim 1 wherein the resiliency of said wall material permits deformation of said upper edge from the configuration of said circular segment to an ellipsoidal segment to engage a ball supported upon said upper edge with its axis inclined with respect to the central axis of said wall about the entire extent of said upper edge.

4. The invention according to claim 3 wherein said upper edge lies in a plane substantially parallel to said flat plane.

5. The invention according to claim 4 wherein the perimetral distance is approximately 240°.

* * * * *